United States Patent [19]

Lowe et al.

[11] Patent Number: 4,620,579

[45] Date of Patent: Nov. 4, 1986

[54] ACCESSORY RECEPTACLE

[75] Inventors: Greg E. Lowe, Boulder; Harold A. Jordan, Longmont, both of Colo.

[73] Assignee: Lowe Alpine Systems, Inc., Lafayette, Colo.

[21] Appl. No.: 675,544

[22] Filed: Nov. 28, 1984

[51] Int. Cl.[4] ..... B65D 11/00

[52] U.S. Cl. ..... 150/52 J; 206/41.57; 206/523

[58] Field of Search ..... 150/52 J; 190/111, 110, 190/109; 206/45.31, 523

[56] References Cited

U.S. PATENT DOCUMENTS

| | | | |
|---|---|---|---|
| D. 257,906 | 1/1981 | Weinreb . | |
| D. 272,965 | 3/1984 | Simon . | |
| D. 273,533 | 4/1984 | Weinreb . | |
| 853,404 | 5/1907 | Gilbert | 190/110 |
| 2,228,493 | 1/1941 | Will | 206/523 |
| 2,844,141 | 7/1958 | Daugherty | 190/111 |
| 2,860,768 | 11/1958 | Smithers | 206/523 |
| 2,911,024 | 11/1959 | Miceli . | |
| 2,960,137 | 11/1960 | Lipsitz . | |
| 3,001,566 | 9/1961 | Lipsitz . | |
| 3,241,661 | 3/1966 | Zam Zow et al. | 206/523 |
| 3,286,834 | 11/1966 | English et al. | 206/523 |
| 3,311,231 | 3/1967 | English, Jr. | 206/523 |
| 4,093,010 | 6/1978 | Hunley et al. | 180/52 J |
| 4,210,186 | 7/1980 | Belenson . | |
| 4,260,004 | 4/1981 | Domke . | |
| 4,403,638 | 9/1983 | Baum . | |
| 4,431,041 | 2/1984 | Leiserson . | |
| 4,513,866 | 4/1985 | Thomas | 190/111 |

FOREIGN PATENT DOCUMENTS

| | | | |
|---|---|---|---|
| 567267 | 5/1958 | Belgium | 190/111 |
| 1333325 | 6/1903 | France | 150/52 J |
| 559357 | 6/1923 | France | 190/111 |
| 1462407 | 12/1966 | France | 206/523 |
| 2280301 | 7/1974 | France | 206/523 |
| 1698 | of 1870 | United Kingdom | 190/110 |
| 592321 | 9/1947 | United Kingdom | 190/111 |

*Primary Examiner*—Joseph Man-Fu Moy
*Attorney, Agent, or Firm*—Robert E. Harris

[57] ABSTRACT

A receptacle for organizing, protecting and identifying accessories, for example, camera accessories, such as video tape, batteries and the like, or photographic accessories, such as film canisters, filters, lens caps and the like, is disclosed. The receptacle, or pouch, may be releasably attached to a bag or other such structure for receiving and retaining equipment such as a camera and/or a video recorder, and may include a carrying handle and/or shoulder strap so that the pouch may be carried separately from the bag or be carried in conjunction with the bag either by being permanently or removably attached thereto. The pouch is configured to receive a cushioning insert a an accessories receiving portion of the pouch, which portion may include the entire pouch, with the cushioning insert having a plurality of cavities defined therein, and with the cushioning insert entirely filling the area of the accessories receiving portion except for the cavities. The cavities are sized to receive different accessories, and a plurality of transparent pockets are positioned at one wall of the pouch, with at least some of these pockets being associated with at least some of the cavities and with the pockets being capable of receiving and thus displaying therein articles and indicia material for identification of articles in associated compartments.

5 Claims, 6 Drawing Figures

ACCESSORY RECEPTACLE

FIELD OF THE INVENTION

This invention relates to an accessory receptacle, and, more particularly, relates to a receptacle for the organization, protection and identification of accessories useful in conjunction with photographic and/or video equipment.

BACKGROUND OF THE INVENTION

Many bags, or cases, to carry various articles have heretofore been suggested and/or utilized, and have heretofore included use of a variety of inserts and dividers in the bag or case to create multiple compartments therein (see, for example, U.S. Pat. Nos. 2,911,024 and 4,210,186 and U.S. Pat. No. Des. 272,965). Various bags or cases have also been suggested, which have included cushioned inserts for fragile articles, for example, U.S. Pat. No. 4,093,010.

Bags or cases have been suggested and/or utilized which have included pockets or pouches appended to the main bag or case, for example, in an inside panel of the bag structure, and some of which have included Velcro strips or the like for releasable attachment of such pouches to primary bag structures. With respect to such bags, attention is drawn, for example, to U.S. Pat. Nos. Des. 257,906 and 273,533, and U.S. Pat. Nos. 2,960,137, 3,001,566 and 4,431,041.

Various bags for carrying camera or video taping equipment have heretofore been suggested and/or utilized, with such bags including the insert and divider mechanisms and appended pocket or pouch features noted above with regard to other bags and cases (see, for example, U.S. Pat. Nos. Des. 257,906 and 273,533 and U.S. Pat. Nos. 4,431,041, 4,260,004 and 4,403,638).

SUMMARY OF THE INVENTION

This invention provides an improved receptacle, or pouch, for organizing, protecting and identifying accessories, for example, photographic or video tape accessories, with the receptacle being capable of utilization either separately or in conjunction with an equipment bag or case. Organization and protection of accessories is achieved through use of a cushioning insert that substantially entirely fills the accessories area of the receptacle except for cavities formed therein to snugly receive the accessories, while the contents of the cavities are made easily identifiable through use of a plurality of pockets attached to the pouch.

It is therefore an object of this invention to provide an improved accessory receptacle.

It is another object of this invention to provide an improved accessories pouch having multiple storage compartments.

It is still another object of this invention to provide an improved receptacle with means for organizing, protecting and identifying accessories therein.

It is still another object of this invention to provide an improved receptacle for use either separately or in conjunction with another bag or case.

It is yet another object of this invention to provide an improved pouch for the storage, protection, organization and identification of photographic and/or video tape accessories having an enclosure dividable into compartments by use of an insert, and having a plurality of pockets for storage of identifying materials attached to the pouch, the proximity of the pockets to the compartments allowing the identification of the compartments contents without removal of the contents therefrom.

With these and other objects in view, which will become apparent to one skilled in the art as the description proceeds, this invention resides in the novel construction, combination and arrangement of parts substantially as hereinafter described, and more particularly defined by the appended claims, it being understood that changes in the precise embodiments of the herein disclosed invention are meant to be included as come within the scope of the claims.

BRIEF DESCRIPTION OF THE DRAWINGS

The accompanying drawings illustrate complete embodiments of the invention according to the best mode so far devised for the practical application of the principles thereof, and in which.

DESCRIPTION OF THE INVENTION

The accessory receptacle, or pouch, of this invention is useful in a variety of configurations, but, in each, the receptacle has an accessory receiving area (which may include the entire receptacle) that is filled with a readily yieldable resilient material having cavities therein for snugly receiving accessories to thereby organize, protect and provide for easy identification thereof.

Figure 1:
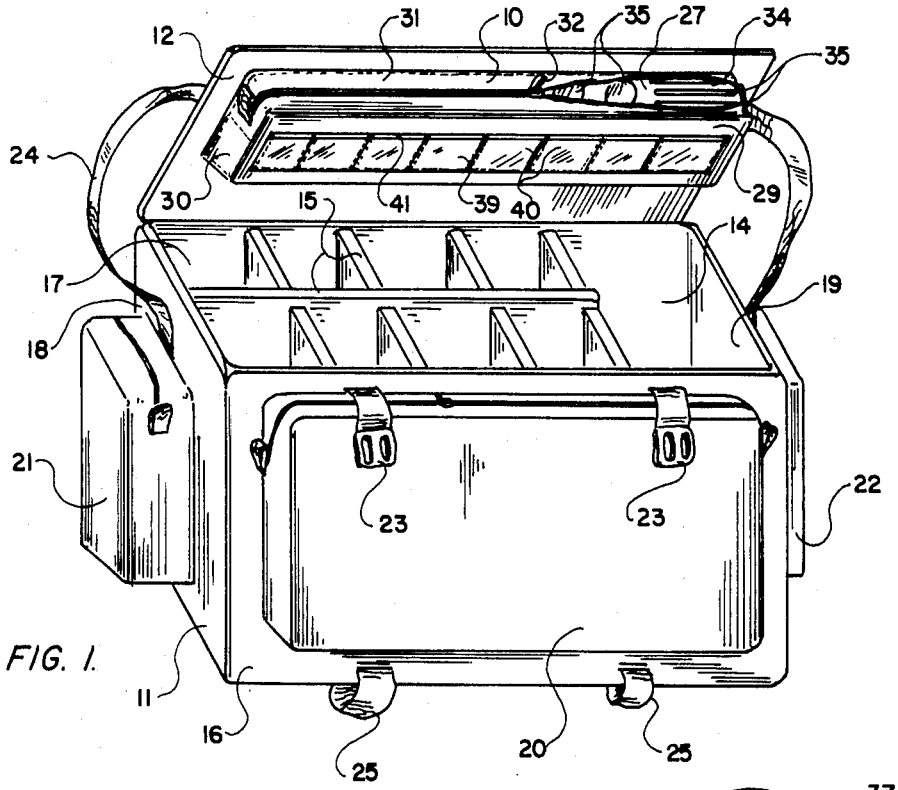
FIG. 1 is a perspective view of an equipment bag having the accessories receptacle, or pouch, of this invention permanently attached to the inside of a top panel of the bag with the bag being viewed from the front side to illustrate viewable pockets thereat.
Figure 2:
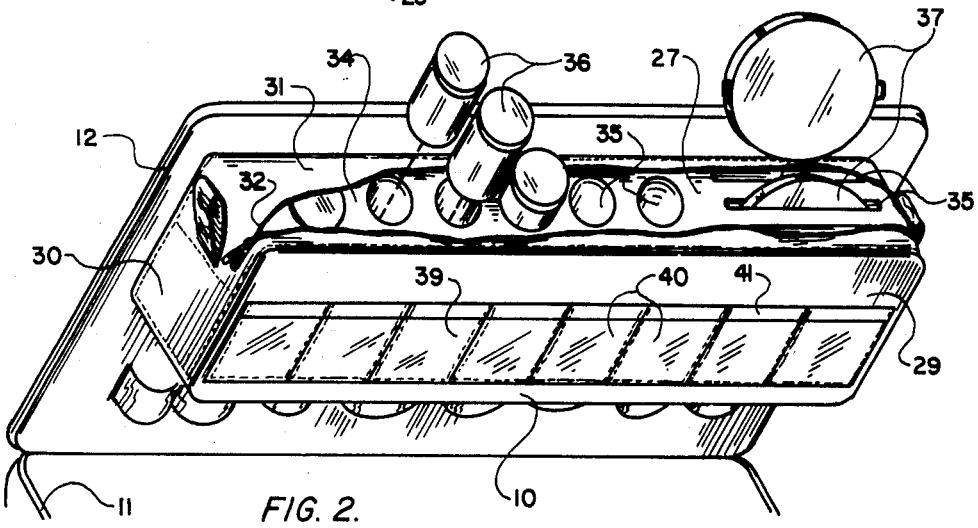
FIG. 2 is an enlarged perspective view of the top panel of an accessories receptacle shown in FIG. 1, and illustrating placement of accessories (film canisters and camera lens caps, as shown) in said receptacle.

As shown in FIGS. 1 and 2, receptacle 10 is mounted in an equipment bag 11 and, more particularly, is shown mounted, by way of example, in hinged top access panel 12 of camera (equipment) bag 11. Camera bag 11 is a conventional type of equipment bag and, as shown in FIG. 1, may include a central, or main compartment 14 having dividers 15 that extend between front and back wall 16 and 17 in one direction and between side walls 18 and 19 in the transverse direction. In addition, front wall 16 and side walls 18 and 19 are shown to have pockets 20, 21 and 22 mounted on the outside thereof, and the top wall, or panel, 12 is hinged at back wall 17 so that the bag can be closed, with the closed condition being maintained, as by buckles 23. A carrying strap 24 is also provided, as are loops 25 for carrying of other ancillary equipment.

Accessory receptacle 10, as shown in FIGS. 1 and 2, has a compartment 27, which is defined by a front panel 29, a bottom panel (not shown), opposite sides 30, and a top panel 31 through which access is provided to compartment 27 through zippered opening 32 therein.

As also shown in FIGS. 1 and 2, accessory receptacle 10 is permanently attached to top access panel 12 and hence no separate back panel is required since panel 12 provides the back panel for the receptacle. As indicated in FIGS. 1 and 2, side panels 30, the bottom panel and top panel 31 are either integral with one another or joined, as by stitching, for example, and are likewise joined, as again by stitching, for example, to top access panel 12 to thereby form the walls for receptacle 10.

Figure 4:
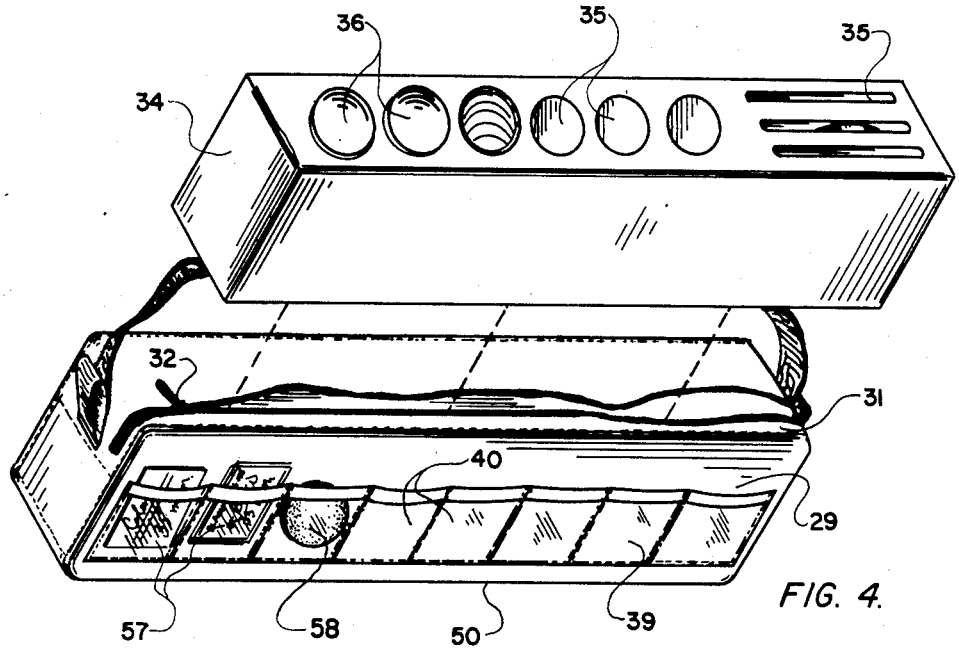
FIG. 4 is an exploded perspective view of the pouch shown in FIG. 3 to illustrate the cushioning insert within the compartment of the pouch.

A cushioning insert 34 (shown in better detail in connection with the embodiment of the receptacle as shown in FIG. 4) of readily yieldable and resilient material is provided within compartment 27 to entirely fill the compartment with this material except for cavities 35 formed in the insert material. Cavities 35 have a predetermined configuration to snugly receive known accessories therein. As shown in FIG. 2, by way of example, cavities 35 may be tubular to receive film canister 36, or be slots to receive camera lens 37, with other cavities (not shown) being also utilizable when configured to receive accessories such as, for example, microphones, cassette cartridges, filters, or the like. In any event, insert 34 provides more mass and hence occupies far more volume within compartment 27 than does the volume provided by the cavities 35 for receiving accessories. By this arrangement, the accessories are received in the accessories area of the receptacle and snugly received thereat so that protection is provided for the accessories and the accessories are definitely organized.

Referring again to FIGS. 1 and 2, accessories receptacle 10 has transparent material 39 attached to the outside of front wall, or panel, 29 to form pockets 40 thereat. As shown in FIGS. 1 and 2, transparent material 31 is attached to wall 29, as by stitching, to form a plurality of pockets 40 each of which is open at the top side thereof (i.e., in the direction away from the hinged portion of top panel 12 of bag 11). A top boarder 41 of a more durable material is provided along the top edge of transparent material 39 to prevent fraying and splitting of the transparent material. As can be readily seen from FIGS. 1 and 2, transparent material 39 provides a window for each of the pockets 40 so that the contents can be readily discerned through the windows. Pockets 40 are attached to receptacle 10 so that the location of at least some of the pockets can be associated with, or correspond to, cavities 35 in cushioning insert 34 to thereby facilitate identification of the contents of an associated cavity by placement of identifying materials (such as indicia as brought out more fully in connection with the embodiment of the invention as shown in FIG. 4, for example). The identifying materials can then serve to indicate the contents of any associated cavity in the receptacle. It is to be realized, of course, that other cavity and pocket configurations could be utilized, and those shown herein are merely for purposes of illustrating the invention.

Figure 3:
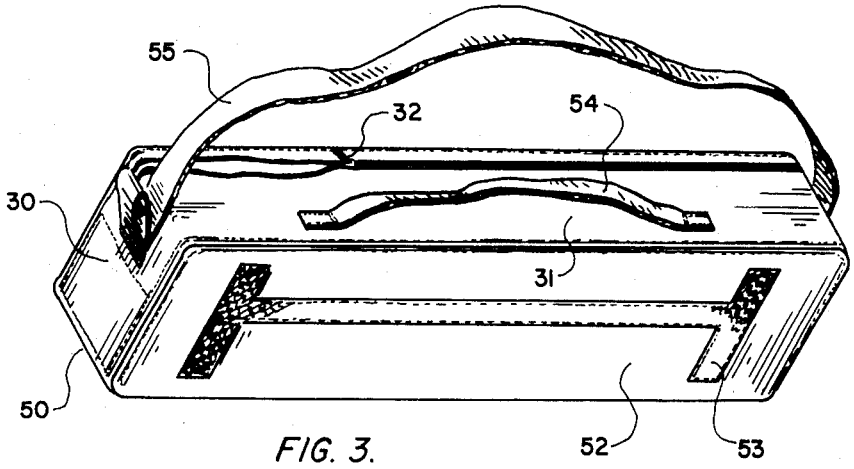
FIG. 3 is a perspective view of an alternate embodiment of the accessory receptacle, as shown in FIGS. 1 and 2, in a form usable by itself and attachable to an equipment bag, with the pouch being viewed from the rear side to illustrate releasable attachment means.

FIGS. 3 and 4 illustrate another embodiment of the invention in which receptacle 50 is releasably attached to a wall of an equipment bag such as shown in FIG. 1, for example. Receptacle 50, as shown in FIGS. 3 and 4, may be identical in structure to that of receptacle 10, as shown in FIGS. 1 and 2, except for the structure necessary for enabling the receptacle to be utilized by itself or as a pouch or carrying case. To this end, receptacle 50 has a back wall, or panel, 52 (receptacle 10 had no independent back wall since the back wall is provided by the top panel of the equipment bag) that is joined to the other walls, as by stitching. To provide for releasable attachment of receptacle 50 to the equipment bag, Velcro strips 53 are provided at back wall 52 to cooperate with strips (not shown) on the equipment bag.

To provide for use of the receptacle as a carrying case, a hand strap 54 is provided at top wall 31 adjacent to zippered opening 32 therein, as shown in FIG. 3. In addition, and as also shown in FIG. 3, shoulder strap 55 may also be provided with such strap being connected to receptacle 50 at sides 30.

As shown in FIG. 4 (which illustrates the front side of receptacle 50), and as brought out more fully in the discussion of receptacle 10, as shown in FIGS. 1 and 2, cushioning insert 34 is a block of readily yieldable and resilient material that entirely fills the accessory compartment of the receptacle except for cavities 35 therein that are configured to snugly receive and retain the predetermined accessories therein. As also brought out in connection with receptacle 10, as shown in FIGS. 1 and 2, pockets 40 are formed by transparent material 39 at the front face 29 of the receptacle so that identifying indicia and/or objects in pockets 40 can be readily discerned. As shown in FIG. 4 for illustrative purposes, identifying indicia 57, such as parts of a film carton, for example, may be placed in pockets 40 associated with film canisters 36 carrying the film taken from the carton. In addition, specific small objects can also be placed in the pockets, such as, for example, a film canister cover 58 as shown in FIG. 4.

Figure 5:
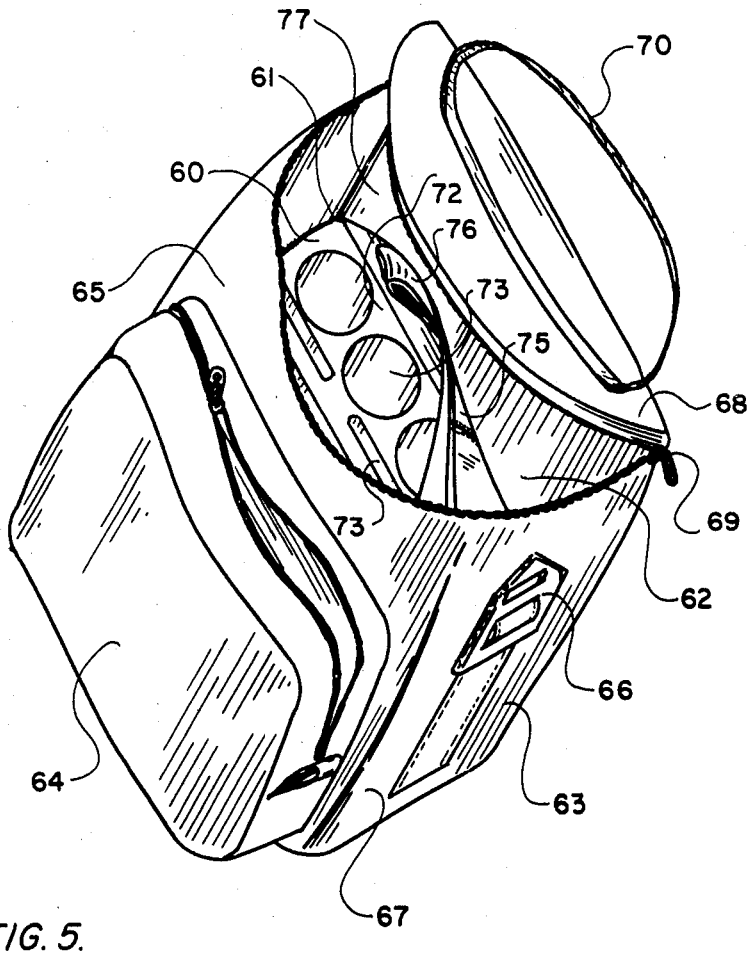
FIG. 5 is a perspective view of a second alternate embodiment of this invention shown incorporated into the bottom portion of an equipment bag.

Another alternate embodiment of the invention is shown in FIG. 5 as receptacle 60. As shown, accessory area 61 is established at the bottom portion of the central, or main, compartment 62 of equipment bag 63. As also shown in FIG. 5, bag 63 may also have an auxiliary pocket 64 at the front wall 65, buckle 66 at the side wall 67 (for attachment of a shoulder strap) and a top wall 68 that may be retained in a closed position by zipper 69 with the top wall also having a hand strap 70 thereon.

Cushioning insert 72 is provided at the accessory area 61 of compartment 62 of bag 63. As indicated in FIG. 5, cushioning insert 72 entirely fills the accessory area 61 except for cavities 73 formed in the insert. Cavities 73 may be identical to those described hereinabove with respect to receptacle 50, but, as indicated in FIG. 5, slot cavities may be positioned adjacent to and at one side of tubular cavities as needed or desired. In addition, a flap 75 having a tab 76 at the front edge thereof may be provided at the top of accessory area 61 with the top being attached to the rear wall 77 of bag 63. Pockets (such as pockets 40 as shown in FIGS. 1 through 4) may also be provided at the surface of flap 75.

Figure 6:
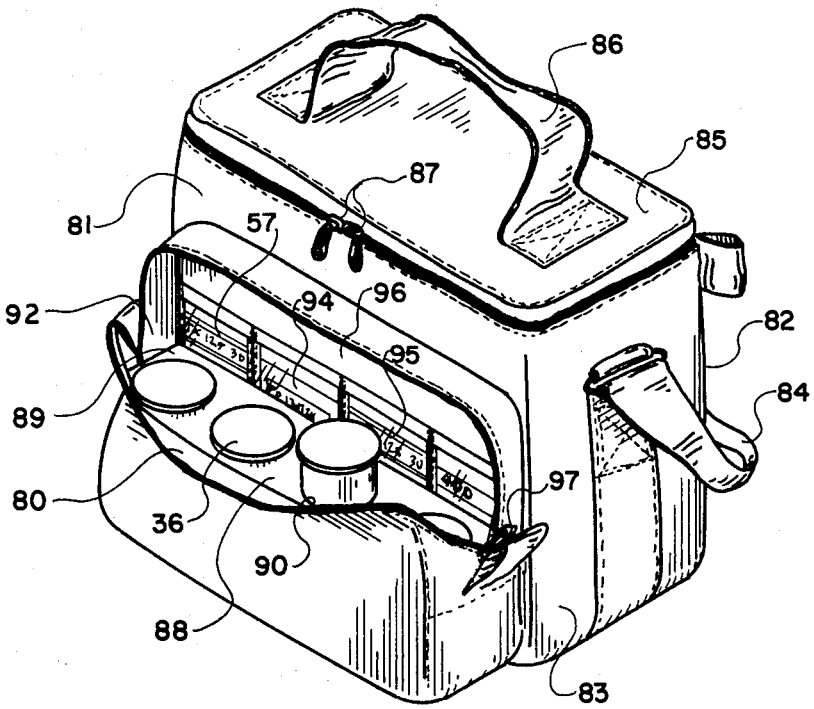
FIG. 6 is a perspective view of a third alternate embodiment of the invention shown incorporated into a side pocket of an equipment bag.

An additional alternate embodiment of this invention is shown in FIG. 6 as a receptacle 80 at the exterior of front side wall 81 of camera bag 82. Camera bag 82 is also shown to have side walls 83 having straps 84 secured thereto, and top wall 85 having strap 86 secured thereto, with top wall 85 being retained in closed position by zippers 87.

As shown in FIG. 6, cushioning insert 88 snugly fits and entirely fills the accessory area 89, except for cavities 90 therein which snugly receives and retain accessories (such as film canisters 36 as shown by way of example in FIG. 6). As also shown in FIG. 6, accessory area 89 is the lower portion of auxiliary compartment 92 mounted in front wall 81 of bag 82. Pockets 94 are formed by stitching transparent material 95 to the upper portion of the back panel 96 (which may be the front wall 81 of bag 83) of compartment 92 so that indicia 57 or accessories in the pockets are viewable when compartment 92 is open. Compartment 92 is maintained in a closed condition by zipper 97.

The accessory receptacle of this invention is preferably made of soft material such as nylon, for example, and the various sections are preferably conventionally fastened together, as by sewing. The transparent material may be made of any clear, lightweight material, and the cushioning insert is preferably made of a light, pliable material, for example, foam rubber. The equipment bags may be made of any water resistant material, such as leather, plastic, or treated cavas, for example.

As can be appreciated from the foregoing, this invention provides an accessory receptacle that is particularly useful in association with equipment bags, such as camera bags and/or video tape equipment bags, to provide organization, protection and identification of accessories.

What is claimed is:

1. Attached to an equipment bag, an accessories organizer comprising:

a cushioning structure formed from a one-piece readily yieldable and resilient solid material having a plurality of spaced cavities defined therein, said cavities adapted to receive different ones of a plurality of said accessories;

first enclosure means including wall means defining at least a first closable compartment therein, said first compartment adapted to receive said structure, said structure substantially occupying all of the interior space of said first closable compartment defined by said wall means; and a plurality of pockets attached to said first enclosure means, said pockets having at least one transparent portion, and at least some ones of which pockets are in proximity to different ones of said cavities, each of said pockets being accessible from at least one direction;

wherein said accessories are snugly received and retained within said cavities for protection thereat, and identifying materials received by said pockets are visible through said transparent portion thereby identifying the contents of said different ones of said cavities in proximity to said some ones of said pockets without removal of either said accessories or said identifying materials from said organizer.

2. The accessories organizer of claim 1 wherein said accessories organizer is releasably attached to one of the interior and the exterior of said equipment bag.

3. The accessories organizer of claim 1 wherein said accessories are film canisters, lens caps, filters and other photographic accessories, and said equipment bag is a camera bag.

4. The accessories organizer of claim 1 wherein said cavities in said structure have a total volume less than that of said structure.

5. The apparatus of claim 1 wherein said cavities receive different ones of tubular and disk-shaped articles.

* * * * *